US010001353B1

(12) United States Patent
Godsey

(10) Patent No.: US 10,001,353 B1
(45) Date of Patent: Jun. 19, 2018

(54) LIGHTED NOCK WITH AN EXTERNAL SWITCH

(71) Applicant: Samuel W. Godsey, Plymouth, WI (US)

(72) Inventor: Samuel W. Godsey, Plymouth, WI (US)

( * ) Notice: Subject to any disclaimer, the term of this patent is extended or adjusted under 35 U.S.C. 154(b) by 22 days.

(21) Appl. No.: 15/196,501

(22) Filed: Jun. 29, 2016

Related U.S. Application Data

(60) Provisional application No. 62/190,896, filed on Jul. 10, 2015.

(51) Int. Cl.

| | |
|---|---|
| ***A63B 37/00*** | (2006.01) |
| ***A63B 39/00*** | (2006.01) |
| ***A63B 41/00*** | (2006.01) |
| ***A63B 65/00*** | (2006.01) |
| ***A63B 43/06*** | (2006.01) |
| ***F42B 6/06*** | (2006.01) |

(52) U.S. Cl.
CPC ..... *F42B 6/06* (2013.01)

(58) Field of Classification Search
CPC ..... F42B 6/06
USPC ..... 473/570, 586, 578, 582
See application file for complete search history.

(56) References Cited

U.S. PATENT DOCUMENTS

| | | | | |
|---|---|---|---|---|
| 4,421,319 | A * | 12/1983 | Murphy | F42B 12/362 473/353 |
| 6,123,631 | A * | 9/2000 | Ginder | F42B 6/06 473/570 |
| 6,736,742 | B2 * | 5/2004 | Price | F42B 6/06 473/570 |
| 8,342,990 | B1 * | 1/2013 | Price | 473/570 |
| 8,758,177 | B2 | 6/2014 | Minica | |
| 9,546,851 | B2 * | 1/2017 | Kim | F42B 12/382 |
| 2011/0312453 | A1 * | 12/2011 | Chu | F42B 6/06 473/570 |
| 2013/0267359 | A1 | 10/2013 | Pedersen | |
| 2014/0121045 | A1 * | 5/2014 | Minica | F42B 6/06 473/570 |

* cited by examiner

*Primary Examiner* — Gene Kim
*Assistant Examiner* — Christopher Glenn
(74) *Attorney, Agent, or Firm* — Donald J. Ersler

(57) ABSTRACT

A lighted nock with an external switch preferably includes a nock body, a light unit, a compression spring and a power source. The nock body preferably includes a string portion and a shank portion. A string slot is formed in the nock body. A battery bore is formed through the shank. A switch opening is formed through a wall of the nock body and into battery bore. The light unit preferably includes a modified top hat LED, an LED housing, an LED housing insert and a switch. The LED housing includes an insert notch for insertion of the LED housing insert. The LED housing insert includes a switch notch. The switch includes a switch base and a pair of snap legs. The LED, LED housing and LED housing insert are assembled and inserted into the battery bore. The switch is inserted through the nock body into the light unit.

13 Claims, 3 Drawing Sheets

LIGHTED NOCK WITH AN EXTERNAL SWITCH

CROSS-REFERENCES TO RELATED APPLICATIONS

This is a utility patent application taking priority from provisional application No. 62/190,896 filed on Jul. 10, 2015.

BACKGROUND OF THE INVENTION

1. Field of the Invention

The present invention relates generally to archery and more specifically to a lighted nock with an external switch, which allows the power to a light source to be turned-off without a tool.

2. Discussion of the Prior Art

U.S. Pat. No. 8,758,177 to Minica discloses a device and method for illuminating an arrow nock. Patent publication no. 2013/0267359 to Pedersen discloses a self-centering nock. Patent publication no. 2014/0121045 to Minica discloses a device and method for illuminating an arrow nock.

Accordingly, there is a clearly felt need in the art for a lighted nock with an external switch, which allows the power to be turned-off without a tool and which includes an elongated light emitting device.

SUMMARY OF THE INVENTION

The present invention provides a lighted nock with an external switch, which includes an elongated light emitting device. The lighted nock with an external switch (lighted nock) preferably includes a nock body, a light unit, a compression spring and a power source. The power source is preferably a pin battery. The nock body preferably includes a string portion and a shank portion extending from one end of the string portion. A string slot is formed in the other end of the string portion. A first pair of opposing notches are formed in opposing sides of the string slot in substantially a middle of a length of the string slot. A second pair of opposing notches are formed near an end of the string slot. A battery bore is formed through the shank portion and into the one end of the string portion. An LED body cavity extends into the string portion from an end of the battery bore. A light hole is formed through an end of the string slot, and into an end of the LED body cavity. A switch opening is formed through a wall of the nock body and into battery bore.

The light unit preferably includes a modified top hat LED, an LED housing, an LED housing insert and a switch. The modified top hat LED includes an elongated light emitting portion, a base portion, a straight electrical lead and a bent electrical lead. The elongated light emitting portion extends from one end of the base portion and the pair of electrical leads extend from an opposing end of the base portion. The LED housing includes a round outer perimeter and an insert notch formed in substantially a middle of a length of the LED housing to receive the LED housing insert. As a result of the insert notch, a first end plate and a second end plate are formed. A pair of lead holes are formed through the first end plate. A lead hole and a bent lead opening are formed through the second end plate. A terminal bore is formed in the second end plate to receive a positive terminal of the pin battery. The LED housing insert includes a half round cylinder and a switch notch formed in one end thereof. The switch includes a switch base and a pair of snap legs. The pair of snap legs extend from the switch base. A distal end of each snap leg is terminated with a snap flange. A distance between the switch base and a bottom of the snap flange is sized to slidably receive a thickness of the LED housing insert.

The light unit is preferably assembled by inserting the two electrical leads through the lead holes and opening in the first and second end plates of the LED housing. The LED housing insert is inserted into the insert notch and the LED housing insert is retained in the insert notch with any suitable device or method. The light unit is then pushed into the battery bore and the LED body cavity. The switch is inserted into switch opening and switch notch, until the snap flanges snap into the LED housing and the LED housing insert. Preferably, the compression spring is inserted into the battery bore. The pin battery is pressed into the battery bore, such that a positive terminal thereof contacts the bent electrical lead, when switch unit is powering the modified top hat LED. The modified top hat LED will emit light when the switch is toggled to the on position, which causes the bent electrical terminal to contact the positive battery terminal. The shank portion is ready to be inserted into an arrow shaft.

Accordingly, it is an object of the present invention to provide a lighted nock with an external switch, which allows the power to be actuated without a tool and which includes an elongated light emitting device.

These and additional objects, advantages, features and benefits of the present invention will become apparent from the following specification.

DETAILED DESCRIPTION OF THE PREFERRED EMBODIMENTS

Figure 1:
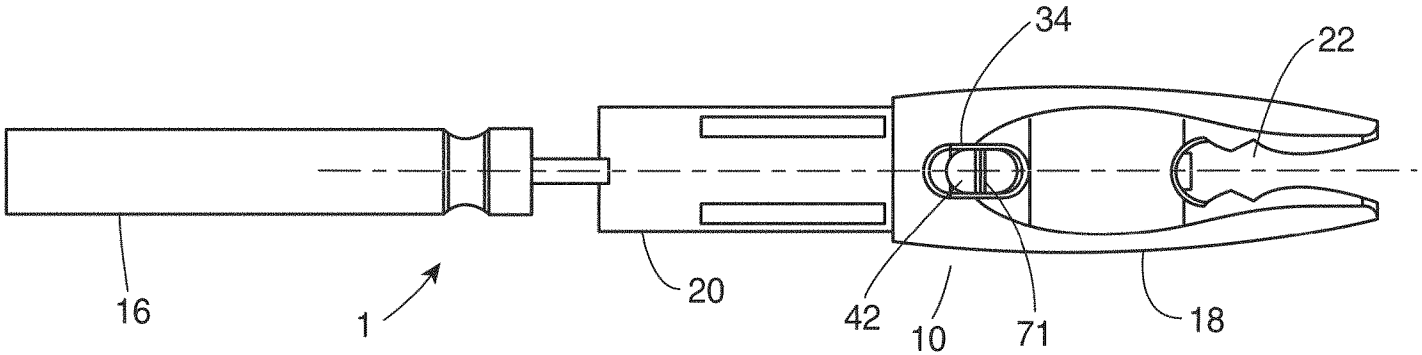
FIG. 1 is a top partially perspective view of a lighted nock before insertion of a pin battery in accordance with the present invention.
Figure 2:
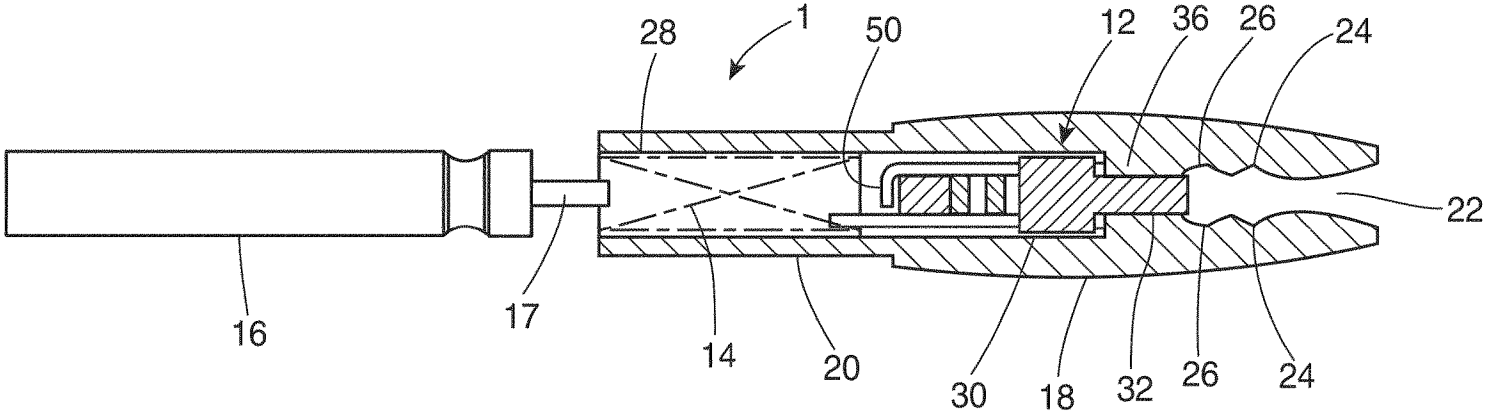
FIG. 2 is a top partially perspective cross sectional view of a lighted nock before insertion of a pin battery in accordance with the present invention.

With reference now to the drawings, and particularly to FIG. 1, there is shown a top partially perspective view of a lighted nock 1 before insertion of a pin battery 16. With reference to FIG. 2, the lighted nock 1 preferably includes a nock body 10, a light unit 12, a compression spring 14 and a power source. The power source is preferably a pin battery 16. The nock body 10 preferably includes a string portion 18 and a shank portion 20, which extends from one end of the string portion 18. A string slot 22 is formed in an opposing end of the string portion 18. A first pair of opposing notches 24 are formed in opposing sides of the string slot 22 in substantially a middle of a length of the string slot 22. A second pair of opposing notches 26 are formed near an end of the string slot 22. A battery bore 28 is formed through the shank portion 20 and into the one end of the string portion 18. An LED body cavity 30 extends into the string portion 18 from a bottom of the battery bore 28. A light hole 32 is formed through an end of the string slot 22 and into the LED body cavity 30. A switch opening 34 is formed through a wall of the nock body 10 and into the battery bore 28.

Figure 4:
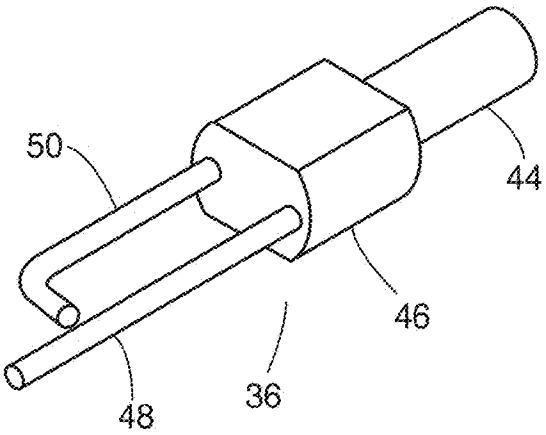
FIG. 4 is a reverse perspective view of an LED housing of a light unit of a lighted nock in accordance with the present invention.
Figure 4:
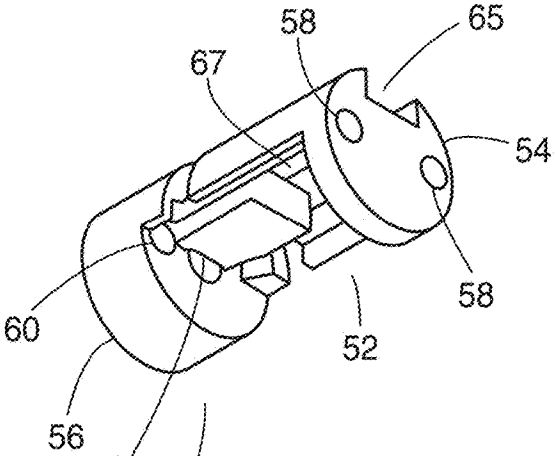
Figure 3:
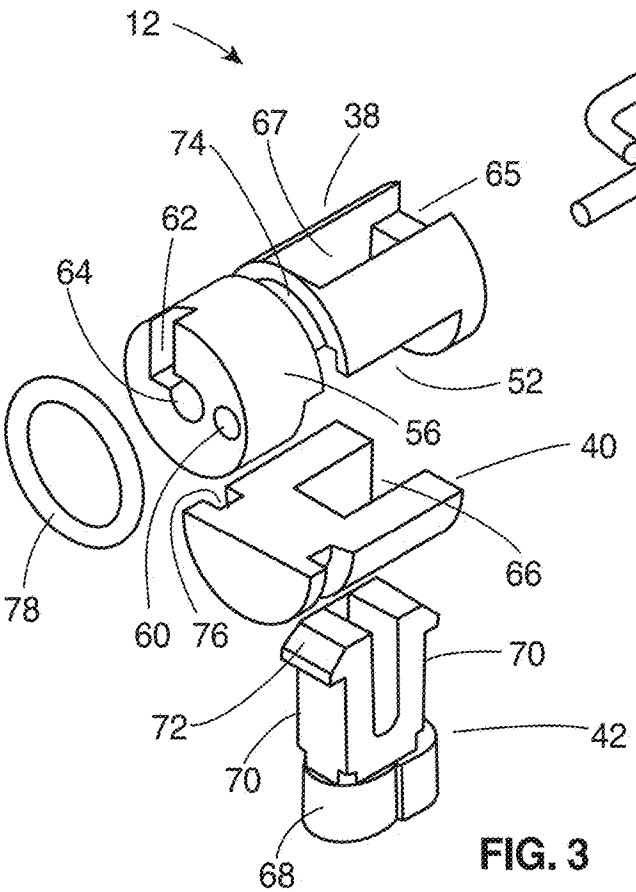
FIG. 3 is an exploded perspective view of a light unit of a lighted nock in accordance with the present invention.
Figure 5:
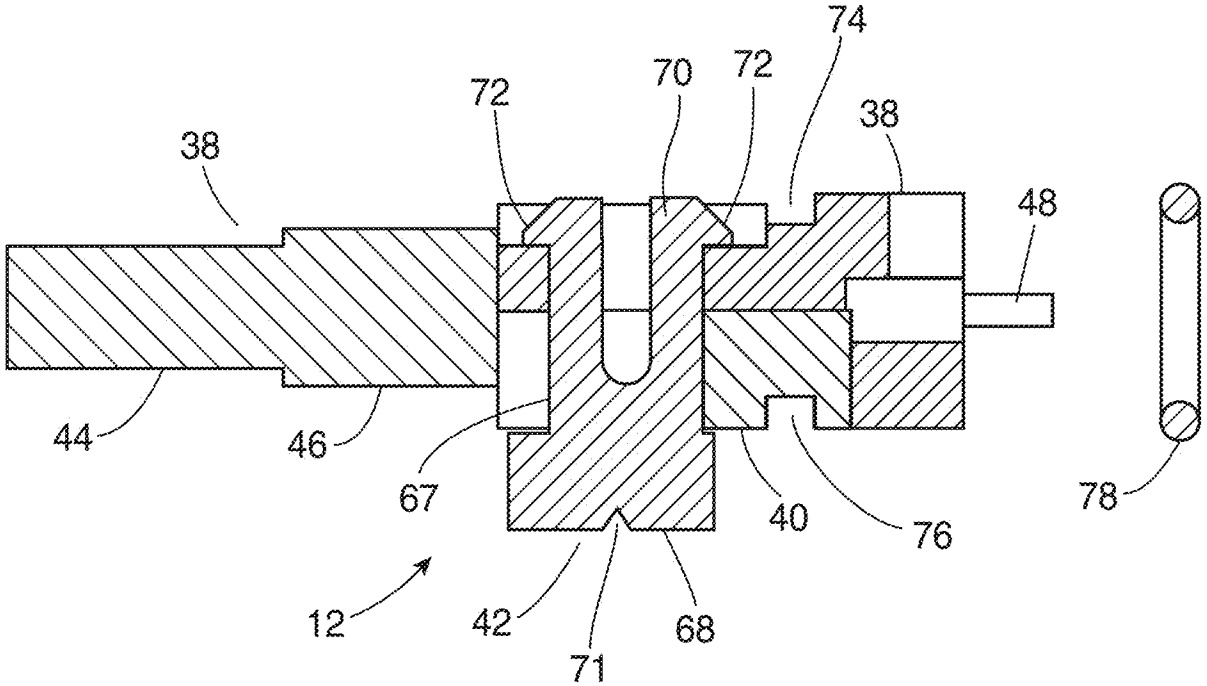
FIG. 5 is a partially exploded cross sectional view of a light unit of a lighted nock in accordance with the present invention.

With reference to FIGS. 3-5, the light unit 12 preferably includes a modified top hat LED 36, an LED housing 38, an LED housing insert 40 and a switch 42. The modified top hat LED 36 includes an elongated light emitting portion 44, a base portion 46, a straight electrical lead 48 and a bent electrical lead 50. The elongated light emitting portion 44 extends from one end of the base portion 46 and the pair of electrical leads 48, 50 extend from an opposing end of the base portion 46. The elongated light emitting portion 44 includes a cylindrical shape. The elongated light emitting portion 44 acts as a light source and a plunger for axially moving the light unit 12 within the battery bore 28. The LED housing 38 includes a round outer perimeter and an insert notch 52 formed in substantially a middle of a length of the LED housing 38 to receive the LED housing insert 40. As a result of the insert notch 52, a first end plate 54 and a second end plate 56 are formed. A pair of lead holes 58 are formed through the first end plate 54. A lead hole 60 and a bent lead opening 62 are formed through the second end plate 56. A terminal bore 64 is formed in the second end plate 56 to receive a positive terminal 17 of the pin battery 16. A switch groove 65 is formed in a top of the LED housing 38. A switch clearance slot 67 is formed through the LED housing 38, adjacent the first end plate 54.

The LED housing insert 40 includes a half round cylinder and a switch notch 66 formed in one end thereof. The switch 42 includes a switch base 68 and a pair of snap legs 70. The pair of snap legs 70 extend from the switch base 68. A toggle slot 71 is preferably formed in a top of the switch base 68. A distal end of each snap leg 70 is terminated with a snap flange 72. The switch unit 12 be toggled between on and off positions by a user by moving the switch 42. A distance between the switch base 68 and a bottom of the snap flange 72 is sized to slidably receive a thickness of the LED housing insert 40. A semi-circular o-ring groove 74 is formed in the LED housing 38, adjacent the second end plate 56 and a semi-circular o-ring groove 76 is formed in the LED housing insert 40 to receive an o-ring 78. The o-ring 78 keeps the light unit 12 assembled outside the battery bore 28 and also provides resistance to axial movement within the battery bore 28.

The light unit 12 is preferably assembled by inserting the two electrical leads 48, 50 through the lead holes 58, 60 and opening 62 in the first and second end plates 54 of the LED housing. The LED housing insert 40 is inserted into the insert notch 52 and the LED housing insert 40 is retained in the insert notch 52 with the o-ring 78 or any other suitable device or method. The light unit 12 is then pushed into the battery bore 28 and the LED body cavity 30. The switch 42 is inserted into switch opening 34 and the switch notch 66, until the snap flanges 72 of the switch 42 snap into the LED housing 38 and the LED housing insert 40.

Preferably, the compression spring 14 is inserted into the battery bore 28. The pin battery 16 is pressed into the battery bore 28, such that a positive terminal 17 thereof contacts the bent electrical lead 50, when switch unit 12 is powering the modified top hat LED 36. The modified top hat LED 36 will emit light when the switch 42 is toggled to the on position, which causes the bent electrical terminal 50 to contact the positive battery terminal 17. The electrical lead 48 will make electrical contact with the grounded case of the pin battery 16. The shank portion 20 is ready to be inserted into an arrow shaft (not shown). A bow string of a archery bow (not shown) is inserted into the string slot 22, until the bow string is retained in the first pair of opposing notches 24. The bow string is pulled back and released, which causes the bow string to go into the second pair of opposing notches 26. The bow string toggles the light unit 12 through the elongated light emitting portion 44, such that the battery terminal 17 contacts the electrical lead 50 and causes electrical current to flow into the modified top hat LED 36 and emit light.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A lighted nock with an external switch comprising:

a nock body includes a string portion and a shank portion, said shank portion extends from said string portion, a string slot is formed in said string portion, a battery bore is formed through said shank portion into said string portion;

a light unit includes a LED and a LED housing, said LED is retained in said LED housing, said LED includes an elongated light emitting portion, a base portion and a pair of electrical leads, said elongated light emitting portion extends from one end of said base portion, said pair of electrical leads extend from an opposing end of said base portion, said electrical leads are retained in said LED housing, wherein said LED housing is retained in said battery bore, said elongated light emitting portion extends into said string slot;

a battery having a ground terminal and a positive terminal is retained in said battery bore, wherein a bow string located in said string slot is capable of pushing said elongated light emitting portion to make an electrical connection between said ground terminal, said positive terminal and said pair of electrical leads to power said LED; and said LED housing includes an insert notch, a LED housing insert is inserted into said insert notch, said LED housing insert includes a switch notch.

2. The lighted nock with an external switch of claim 1 wherein:

a first pair of opposing notches are formed in opposing sides of said string slot in substantially a middle of a length of said string slot.

3. The lighted nock with an external switch of claim 1 wherein:

a second pair of opposing notches are formed near an end of said string slot.

4. The lighted nock with an external switch of claim 1, further comprising: said pair of electrical leads are retained in said LED housing.

5. The lighted nock with an external switch of claim 1, further comprising:

a switch; and a switch opening is formed through a wall of said nock body, said switch extends into said switch opening, wherein said switch is capable of being actuated without a tool.

6. The lighted nock with an external switch of claim 5 wherein:

said switch includes a pair of snap legs and a switch base, said pair of snap legs extend from said switch base, a distal end of each snap leg is terminated with a snap flange, wherein said pair of snap legs are inserted through a side wall of said nock body and into said LED housing.

7. A lighted nock with an external switch comprising:

a nock body includes a string portion and a shank portion, said shank portion extends from said string portion, a string slot is formed in said string portion, a battery bore is formed through said shank portion into said string portion;

a light unit includes a LED and a switch, said LED includes a pair of electrical leads, a switch opening is formed through a wall of said nock body, said switch extends into said switch opening, wherein said switch is capable of being actuated without a tool, an end of said LED extends into said string slot;

a battery having a ground terminal and a positive terminal is retained in said battery bore, one of said pair of electrical leads has an electrical connection to one of said ground terminal and said positive terminal, wherein a bow string located in said string slot is capable of pushing said LED and moving said switch to power said LED; and said switch includes a pair of snap legs and a switch base, said pair of snap legs extend from said switch base, a distal end of each snap leg is terminated with a snap flange, wherein said pair of snap legs are inserted through a side wall of said nock body and into said LED housing.

8. The lighted nock with an external switch of claim 7 wherein:

a first pair of opposing notches are formed in opposing sides of said string slot in substantially a middle of a length of said string slot.

9. The lighted nock with an external switch of claim 8 wherein:

a second pair of opposing notches are formed near an end of said string slot.

10. The lighted nock with an external switch of claim 7 wherein:

said LED includes an elongated light emitting portion, a base portion and said pair of electrical leads, said pair of electrical leads includes a straight electrical lead and a bent electrical lead, said elongated light emitting portion extends from one end of said base portion, said pair of electrical leads extend from an opposing end of said base portion, said elongated light emitting portion has a cylindrical shape.

11. The lighted nock with an external switch of claim 10, further comprising:

said pair of electrical leads are retained in a LED housing.

12. The lighted nock with an external switch of claim 11 wherein:

said LED housing includes an insert notch, an LED housing insert is inserted into said insert notch, said LED housing insert includes a switch notch.

13. A lighted nock with an external switch comprising: a nock body includes a string portion and a shank portion, said shank portion extends from said string portion, a string slot is formed in said string portion, a battery bore is formed through said shank portion into said string portion; a light unit includes a LED and a switch, said LED includes an elongated light emitting portion, a base portion and a pair of electrical leads, said elongated light emitting portion extends from one end of said base portion, said pair of electrical leads extend from an opposing end of said base portion, a switch opening is formed through a wall of said nock body, said switch extends into said switch opening, an end of said elongated light emitting portion extends into said string slot; and a battery having a ground terminal and a positive terminal retained in said battery bore, wherein a bow string located in said string slot is capable of pushing said LED and moving said switch to power said LED; said pair of electrical leads are retained in a LED housing; and said LED housing includes an insert notch, an LED housing insert is inserted into said insert notch, said LED housing insert includes a switch notch.

* * * * *